US006601329B2

(12) United States Patent
Vaudreuil

(10) Patent No.: US 6,601,329 B2
(45) Date of Patent: Aug. 5, 2003

(54) CARD HOLDER

(76) Inventor: René Vaudreuil, 395 Audouard, Beauport, Québec (CA), G1C 6M2

( * ) Notice: Subject to any disclaimer, the term of this patent is extended or adjusted under 35 U.S.C. 154(b) by 26 days.

(21) Appl. No.: 09/803,892

(22) Filed: Mar. 13, 2001

(65) Prior Publication Data

US 2002/0129527 A1 Sep. 19, 2002

(51) Int. Cl.[7] ..... G09F 3/20
(52) U.S. Cl. ..... 40/655; 40/642.02; 206/807
(58) Field of Search ..... 40/655, 642.02, 40/661.06, 661.07, 712, 779, 781, 626, 661, 625, 649, 729, 765, 1.5, 124.06; 206/37, 807

(56) References Cited

U.S. PATENT DOCUMENTS 4,583,309 A * 4/1986 Kane et al. ..... 40/711
4,984,683 A * 1/1991 Eller ..... 206/38
5,134,794 A * 8/1992 Walrath ..... 40/781
5,148,618 A * 9/1992 Brewster ..... 40/626
5,161,827 A * 11/1992 Grosso ..... 283/109
5,529,173 A * 6/1996 Salacuse ..... 206/1.7
5,740,624 A * 4/1998 Baseley ..... 40/649
5,791,461 A * 8/1998 Tsuge ..... 206/39.4
5,950,287 A * 9/1999 Cacciatore et al. ..... 27/1
6,176,029 B1 * 1/2001 Maier-Hunke ..... 40/649

* cited by examiner

*Primary Examiner*—William L. Miller

(57) ABSTRACT

A card holder for securely linking together an identification card to a validation card so as to prevent fraudulent removal of the identification and validation cards once the latter have been inserted into the card holder. The card holder defines a generally flat and hollow casing. The identification card is adapted to be secured within the casing so that it can be visualized through a window aperture formed therein. A carriage component defining a carriage slot is slidably mounted within the casing inner volume over the first card. The carriage slot is provided with protrusions adapted to cooperate with corresponding notches formed in a marginal upper segment of the validation card for securing the latter to the carriage. The carriage and associated validation card are adapted to slide between a storage configuration wherein the validation card generally overlies the identification card and a display configuration wherein the identification and validation cards are in an offset relationship relative to each other allowing their simultaneous display.

20 Claims, 5 Drawing Sheets

CARD HOLDER

FIELD OF THE INVENTION

The present invention relates to the general field of card holders and is particularly concerned with a card holder for securely linking together a pair of cards and for allowing the selective display of the cards.

BACKGROUND OF THE INVENTION

There exists a plurality of situations wherein cards are used for identifying owners of given rights.

For example, so-called validation cards such as transit fare cards, museum passes or the like, typically procure the owner of the card with the right to certain services or access to restricted areas.

Since such cards procure access, services or the like to a limited number of individuals, their acquisition typically requires purchasing thereof or membership to a given subset of individuals or group such as appurtenance to a given municipality or the like. Since the so called validation cards procure given rights to only a limited number of individuals, there exists a risk that fraudulent individuals may try to pass off these rights to other individuals in a fraudulent manner without the other individuals purchasing or legally acquiring the right associated with possession of the validation card.

In order to reduce such risks, some validation cards are provided with identification features allowing for identification of the individual to which the card belongs. However, in some instances, it is not desirable or feasible to provide identification information on the validation card itself. For example, in situations wherein the validation card is periodically changed, it may become a tedious process to provide the validation card with individualized information identifying its owner.

This type of situation commonly occurs with public transit fare cards emitted monthly by municipalities and typically purchased by individuals at various retail sites. In such situations, it is common practice to couple or link the validation card to an identification card bearing identification information, such as a photograph and identifying inscriptions.

The prior art shows various card holders allowing for coupling of identification card to validation cards. However, these prior art card holders suffer from a major drawback in that both the identification card and the validation card are not secured to the card holder and thus allow relatively easy removal of both the identification card and the validation card from the card holder.

This proves to be a major drawback since it allows fraudulent individuals to switch and exchange identification and validation cards. For example, the owner of an identification card having purchased a valid validation card may remove the validation card from the card holder. Once removed, the validation card could easily be fraudulently sold or otherwise transferred to another identification card owner. The second owner merely needs to insert the fraudulently acquired validation card into the card holder to combine it with the identification card in order to be able to fraudulently use the identification and validation card combination. Conversely, a fraudulent user merely needs to remove an identification card from a prior art card holder in order to insert it into another card holder already holding a valid validation card in order to be able to again fraudulently use an identification and validation cards combination. The fraudulent exchange of validation cards in certain industries and services such as in the public transfer systems results in considerable financial losses. Accordingly, there exists a need for an improved card holder.

Advantages of the present invention include the fact the proposed card holder allows for securely linking together an identification card to a validation card so as to reduce the risks of having either the identification card or the validation card removed from the card holder without noticeable clues to the effect that the cards have been removed from the card holder. More specifically, the proposed card holder ensures that once the identification and validation card have been inserted thereinto, the removal of either the identification or the validation card requires either noticeable tampering of the card holder or destruction of the cards. The risks of fraudulent exchange of validation and identification cards is thus reduced.

Still further, the proposed card holder is specifically designed so as to allow the securement thereinto of only one identification card and only one validation card. More specifically, once the validation and identification cards have been inserted into the card holder, the latter prevents another identification or validation cards from being inserted thereinto so as to reduce the risks of having fraudulent identification and validation cards masking legally acquired identification and validation cards.

Still further, the proposed card holder optionally provides means for selectively facilitating the destruction of a validation card without tampering the card holder so as to facilitate the withdrawal of the second card from the card holder without tampering or destruction of the latter, for example in situations wherein the same identification card is to be used with periodically changing validation cards.

Still further, the proposed card holder allows for the selective display of either one or both cards through a set of easy and ergonomic steps. The proposed card holder also allows for attachment thereto of a specially designed validation card through a single ergonomical step.

The proposed card holder is also specifically designed so as to be configurable between a storage configuration minimizing required storage space and a display configuration allowing the simultaneous display of both the identification and validation cards. The proposed card holder allows for switching between the storage and display configurations through a step of quick and ergonomical steps.

The proposed card holder is specifically designed so as to be manufacturable using conventional forms of manufacturing so as to provide a card holder that will be economically feasible, long lasting and relatively trouble free in operation.

In accordance with an embodiment of the invention, there is provided a card holder for securely linking together a first card and a second card and for allowing the selective display of the first and second cards, the first card having a generally flat configuration defining a first card first face and an opposed first card second face, the second card having a generally flat configuration defining a second card peripheral edge, a second card marginal section extending from the second card peripheral edge, a second card first face and an opposed second card second face, the card holder comprising: a first card holding component for holding the first card, the first card holding component being provided with a first card securing means for securing the first card to the first card holding component, the first card securing means ensuring that once the first card is secured to the first card holding component the removal of the first card from the first card holding component requires tampering of the first card or of the first card holding component; a second card holding component for holding the second card, the second card holding component being provided with a second card securing means for securing the second card to the second card holding component, the second card securing means ensuring that once the second card is secured to the second card holding component the removal of the second card from the second card holding component requires the destruction of the second card or tampering of the second card holding component; a component linking means for securely linking together the first and second card holding components, the linking means ensuring that once the first and second card holding components are linked together, the separation of the first and second card holding components from each other requires tampering of the component linking means.

Preferably, the component linking means allows the first and second card holding components to be moved between a storage configuration wherein the first and second card holding components are in a generally superposed configuration relative to each other and a display configuration wherein at least a section of the first and second cards are in a generally offset relationship relative to each other;

whereby the storage configuration reduces the storage space required for storing the card holder and the display configuration allows the simultaneous display of at least a section of both the first card first face and the second card first face.

Conveniently, the first card holding component includes a first component plate, the first component plate defining a plate first surface and an opposed plate second surface, the first card second face being secured to the plate first surface by the first card securing means; the second card holding component includes a carriage component, the carriage component defining a carriage body, the carriage body having a carriage slot extending thereinto, the carriage slot defining a carriage slot first inner surface, an opposed carriage slot second inner surface, a carriage slot upper peripheral edge, a pair of opposed carriage slot side peripheral edges, and a slot insertion axis extending in a direction generally parallel to the carriage slot first and second inner surfaces; the carriage slot being configured and sized for slidably receiving the second card marginal section with the second card first and second faces in the region of the second card marginal section respectively facing the carriage slot second and first inner surfaces; the second card securing means includes a second card-to-carriage locking means located in the carriage slot, the second card-to-carriage locking means ensuring that once the second card marginal section is slidably inserted in the carriage slot the removal of the second card marginal section from the carriage slot requires the destruction of the second card or tampering of the second card holding component.

Typically, the card holder further comprises a selection means for selectively facilitating the destruction of the second card without tampering of the card holder so as to facilitate the withdrawal of the second card from the card holder without tampering or destruction of the latter.

Preferably, the second card-to-carriage locking means includes a card locking protrusion extending partially between the carriage slot first and second inner surfaces; a card locking aperture formed in the marginal section, the card locking aperture being configured, sized and positioned so as to receive the card locking protrusion when the marginal section is inserted into the carriage slot; the carriage slot, the card locking protrusion and the card locking aperture being configured and sized so as to prevent the withdrawal of the card locking protrusion from the card locking aperture once the card locking protrusion has been inserted into the card locking aperture.

Conveniently, the second card has a generally rectangular configuration defining a second card upper peripheral edge, a second card lower peripheral edge and a pair of opposed second card side peripheral edges; the marginal section extends from the second card upper peripheral edge, the marginal section being made of a substantially resilient material; the card locking aperture forms a notch extending from one of the second card side peripheral edges into the marginal section, the notch defining a notch locking edge, the notch also defining a card resilient flap extending from one of the second card side peripheral edges intermediate the notch locking edge and the second card upper peripheral edge; the card locking protrusion is positioned adjacent the slot side peripheral edge, the card locking protrusion defining a protrusion distal tip, the card locking protrusion having a generally beveled configuration defining a protrusion locking surface extending in a geometrical plane generally perpendicular to the slot insertion axis, the card locking protrusion also defining a protrusion segment guiding surface extending in a geometrical plane generally at an angle relative to the protrusion locking surface, the protrusion tip being spaced from an opposite peripheral surface of the carriage slot by an insertion spacing; whereby when the card resilient flap is unbiased it lies in a generally coplanar flap initial configuration relative to the rest of the second card, when the marginal section is inserted into the carriage slot, the card resilient flap bends sidewardly as it slides onto the guiding surface eventually passing through the insertion spacing; once the notch locking edge has cleared the insertion spacing, the resilient flap springs back to its flap initial configuration with the notch locking edge abuttingly contacting the protrusion locking surface and preventing the withdrawal of the marginal section from the carriage slot.

Preferably, an insertion recess is formed in the carriage slot opposite the protrusion tip, the protrusion tip being located substantially in register with the entrance of the insertion recess; whereby the locking protrusion temporarily biases the card resilient flap into the insertion recess as the resilient flap slides over the protrusion tip.

Conveniently, the carriage component includes a carriage front wall, a carriage rear wall, a carriage top wall and a carriage bottom wall, the carriage slot extending into the carriage bottom wall; a protective skirt extending from the carriage rear wall in a direction leading away from the carriage bottom wall, the protective skirt defining a skirt inner surface, the skirt inner surface being in a generally coplanar relative to the carriage slot first inner surface, the protective skirt also defining a skirt lower peripheral edge; a stabilizing protrusion protruding from the carriage slot first inner surface, the stabilizing protrusion extending from a position adjacent the slot upper peripheral edge to a position adjacent the skirt lower peripheral edge.

Preferably, the carriage component includes a first carriage section and a second carriage section, the first and second carriage sections being configured so as to define the carriage component when assembled together in a carriage assembled configuration; a carriage section securing means for securing the first and second carriage sections in the carriage assembled configuration. Conveniently, the first carriage section includes a generally flat first section panel, the inner surface of the first section panel forming the carriage slot first inner surface and the skirt inner surface;

the second carriage section includes a generally elongated second section block having a second section flange extending perpendicularly therefrom; the rear section of the second section block forming the carriage front wall while the bottom section of the second section block forms part of the carriage lower wall; the inner surface of the second section block forming the slot second inner surface; the second section flange and the top section of the second section block forming the carriage top wall.

Preferably, the card locking protrusion and the stabilizing protrusion protrudes from the inner surface of the first carriage section; the carriage section securing means includes carriage securing pins extending from the inner surface of the second section block and carriage securing apertures formed in the stabilizing protrusion, each of the carriage securing apertures being configured sized and positioned for lockingly receiving a corresponding carriage securing pin. Conveniently, the component linking means allows the first and second card holding components to be slidably moved relative to each other between the storage and display configurations.

Preferably, the component linking means includes a guiding skate and guiding rail arrangement extending between the carriage component and the first card holding component for allowing the carriage component and the first card holding component to slide relative to each other.

Typically, the first card holding component further includes a first component front wall maintained in a parallel and spaced relationship relative to the first component plate by a first component top wall, a first component bottom wall and a pair of first component side walls; the first component front wall having a window aperture extending therethrough so that the first component front wall defines a window frame around the window aperture surrounding a window aperture; the first component bottom wall having a first component slot extending therethrough; the first component slot allowing the slidable movement of the second card thereinto when the card holder switches between the storage and display configurations;

the window aperture allowing the display of the first card first face when the card holder is in the display configuration and the display of the second card first face when the card holder is in the storage configuration; whereby the first component plate, the first component front wall, the first component top wall, the first component bottom wall and the pair of first component side walls form a hollow casing for containing both the first and second cards when the card holder is in the storage configuration.

Preferably, the carriage component includes a carriage front wall, a carriage rear wall, a carriage top wall, a carriage bottom wall and a pair of carriage side walls, the carriage slot extending into the carriage bottom wall; the carriage component also including a protective skirt extending from the carriage rear wall in a direction leading away from the carriage bottom wall, the protective skirt defining a skirt inner surface substantially coplanar with the carriage slot first inner surface, the protective skirt also defining a skirt lower peripheral edge; a guiding rail extends inwardly from each of the first component side walls and a guiding skate extends from each of the carriage side walls. Conveniently, the skirt lower peripheral edge is substantially in register with the first component bottom wall when the card holder is in the display configuration.

Optionnally, the card holder futehr comprises a selection means for selectively facilitating the destruction of the second card without tampering of the card holder so as to facilitate the withdrawal of the second card from the card holder without tampering or destruction of the latter; the selection means including a card recess formed in the second card, the card recess extending from the second card upper peripheral edge to a position located below the carriage bottom wall when the marginal section is inserted into the carriage slot and the card holder is in the display configuration.

Preferably, the first component front wall, the first component top wall, the first component bottom wall and the pair of first component side walls form an integral piece of material assembled and secured to the first component plate by a first component securing means.

In accordance with the present invention there is also provided a card holder for securely linking together a first card and a second card and for allowing the selective display of the first and second cards, the first card having a generally flat configuration defining a first card first face and an opposed first card second face, the second card having a generally flat configuration defining a second card peripheral edge, a second card marginal section extending from the second card peripheral edge, a second card first face and an opposed second card second face, the card holder comprising: a generally flat and hollow casing, the casing defining a casing front wall, an opposed casing rear wall, a casing top wall, an opposed casing bottom wall, a pair of casing side walls and a casing inner volume; the casing rear wall defining a rear wall inner surface and a rear wall outer surface; the casing front wall having a window aperture extending therethrough; the casing bottom wall having a bottom wall slot extending therethrough; a carriage component slidably mounted within the casing inner volume; a first card securing means for securing the first card to the rear wall inner surface, the first card securing means ensuring that once the first card is secured to the rear wall inner surface the removal of the first card from the rear wall inner surface requires tampering of the first card or of the first card or of the card holder; a carriage component securing means for securing the second card to the carriage component, the carriage component securing means ensuring that once the second card is secured to carriage component the removal of the second card from the carriage component requires the destruction of the second card or tampering of the card holder.

Preferably, the carriage component securing means includes a carriage slot formed in the carriage component; the carriage slot defining a carriage slot first inner surface, an opposed carriage slot second inner surface, a carriage slot upper peripheral edge, a pair of opposed carriage slot side peripheral edges, and a slot insertion axis extending in a direction generally parallel to the carriage slot first and second inner surfaces; the carriage slot being configured and sized for slidably receiving the second card marginal section with the second card first and second faces in the region of the second card marginal section respectively facing the carriage slot second and first inner surfaces; the second card securing means includes a second card-to-carriage locking means located in the carriage slot, the second card-to-carriage locking means ensuring that once the second card marginal section is slidably inserted in the carriage slot the removal of the second card marginal section from the carriage slot requires the destruction of the second card or tampering of the second card holding component.

BRIEF DESCRIPTION OF THE DRAWINGS

An embodiment of the present invention will now be shown, by way of example, in reference to the following drawings in which.

DETAILED DESCRIPTION

Figure 1:
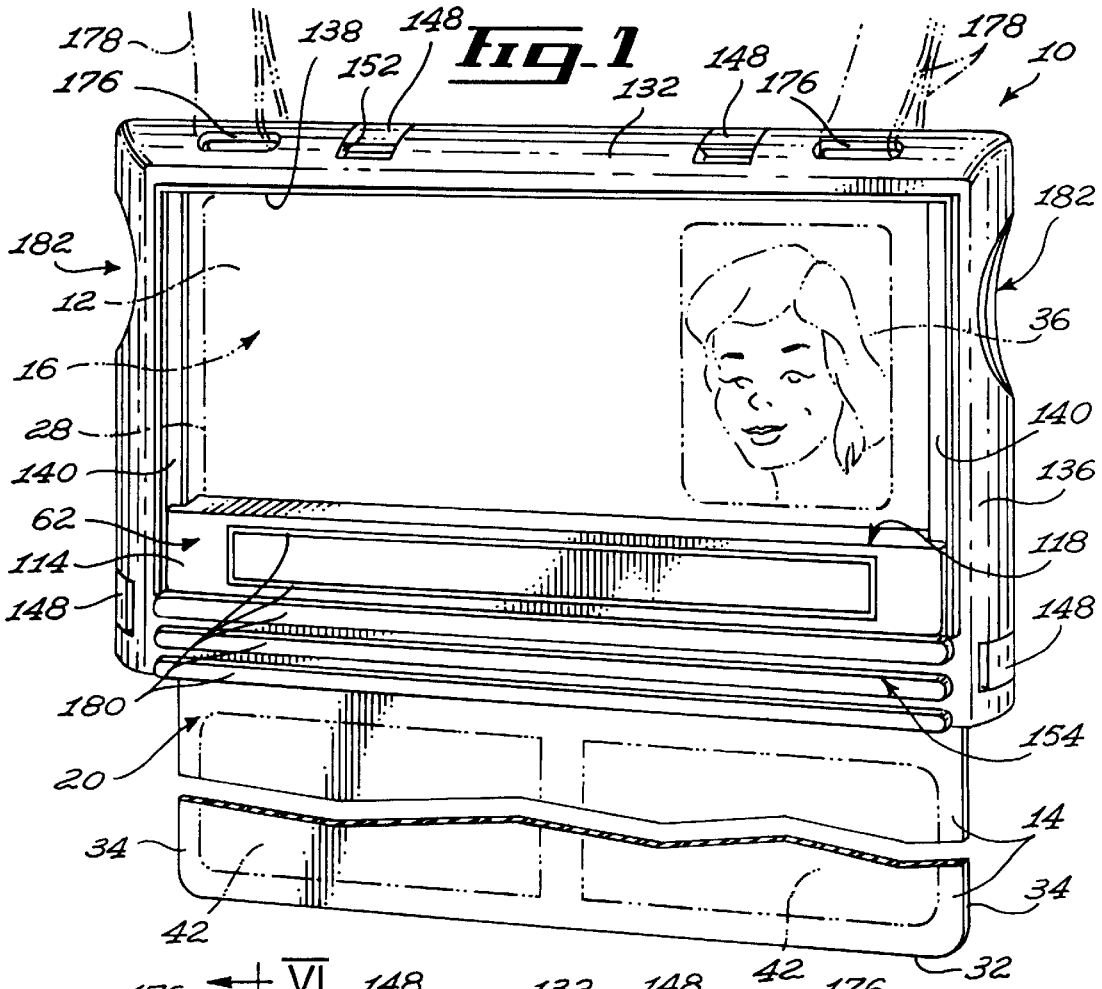
FIG. 1: in a perspective view, illustrates a card holder in accordance with an embodiment of the present invention, the card holder being shown with a pair of cards mounted therein and in a display configuration.

Referring to FIG. 1, there is shown a card holder (10) in accordance with an embodiment of the present invention. The card holder (10) is shown holding a first card (12) and a second card (14). Typically, although by no means exclusively, the first card (12) is an identification card while the second card (14) is a purchased card procuring certain rights such as a transit fare card, a museum pass or the like.

Figure 4:
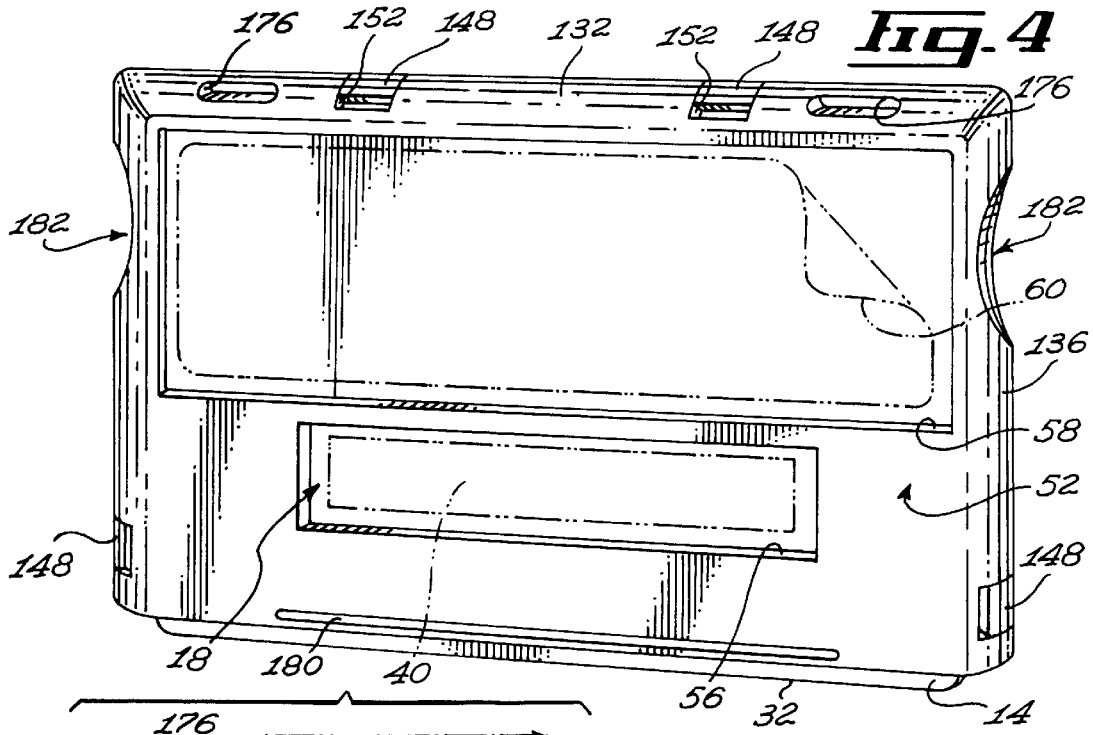
FIG. 4: in a rear perspective view, illustrates a card holder in accordance with an embodiment of the present invention, the card holder being shown with a message sticker being attached thereto.
Figure 5:
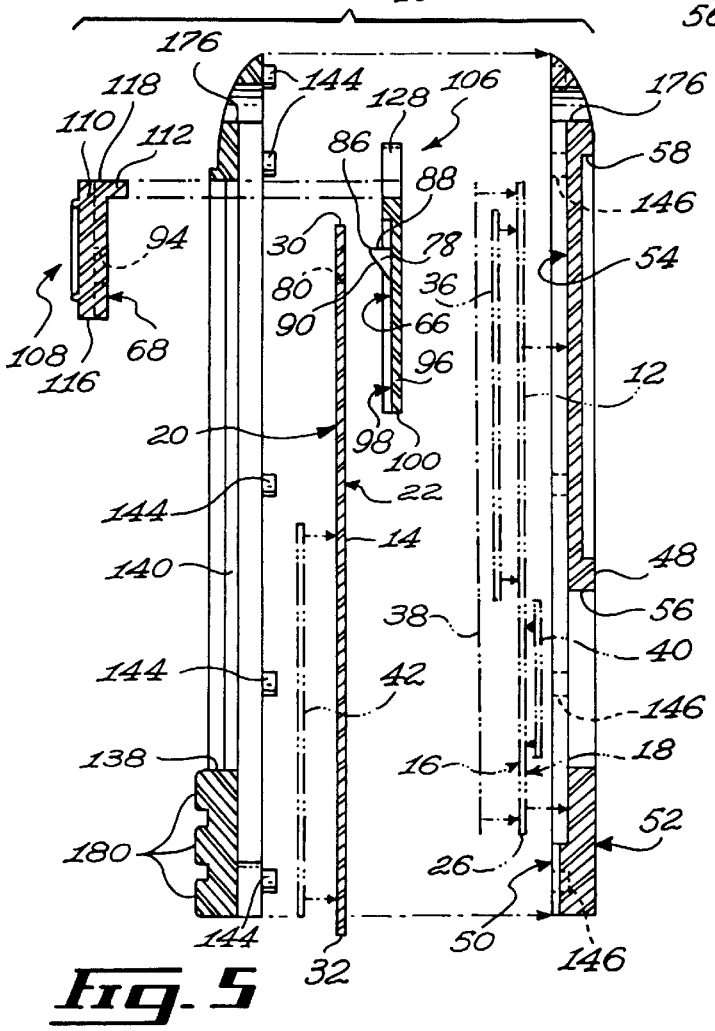
FIG. 5: in a partial exploded transversal cross sectional view, illustrates a card holder in accordance with an embodiment of the present invention with a pair of cards having specific display configurations about to be attached thereto.

As shown more specifically in FIG. 5, both the first card (12) and the second card (14) typically have generally flat cross sectional configurations defining corresponding first card, first and second faces (16), (18) and second card, first and second faces (20), (22). As shown more specifically in FIGS. 1 through 4 and 11 through 13, the first and second cards (12), (14) have generally rectangular elevational configurations defining corresponding first card upper, lower and side peripheral edges (24), (26) and (28) and second card upper, lower and side peripheral edges (30), (32) and (34). It should however be understood that the card holder (10) could accommodate first and second cards (12), (14) having other configurations without departing from the scope of the present invention.

FIG. 5 also illustrates, by way of example, a typical display configuration for both the first and second cards (12), (14). The first card (12) typically has an identification picture such as the photograph (36) of the intended user adhesively mounted on its first card first face (16) adjacent printed or otherwise marked identification information (not shown). A substantially transparent coating film (38) is typically mounted over the first card first face (16) so as to protect the latter against moisture, dirt or the like.

Optionally, an identification sticker such as a bar-code strip (40) is adhesively secured to the first card second face (18). The bar-code strip (40) could optionally be provided with signal emitting means such as a GPS emitter or the like. The bar-code information could further also be directly printed or otherwise marked on the first card, first or second faces (16), (18).

Optionally, at least one, and preferably a pair of validation stickers (42) acting as proof of validation or of purchase are adhesively or otherwise affixed once the second card (14) has been validated to the second card, first surface (20). Again, it should be understood that the card holder (10) could hold first and second cards (12), (14) having other display configurations without departing from the scope of the present invention.

The card holder (10) includes a first card holding component (44) for holding the first card (12) and a second card holding component (46) for holding the second card (14). The card holder (10) also includes a component linking means for securely linking together the first and second card holding components (12), (14).

The first card holding component (44) is provided with a first card securing means for securing the first the card (12) to the first card holding component (44). The first card securing means is designed so as to ensure that once the first card (12) is secured to the first card holding component (44), the removal of the first card (12) from the first card holding component (44) requires tampering of the first card (12) or of the first card holding component (44).

Similarly, the second card holding component (46) is provided with a second card securing means for securing the second card (14) to the second card holding component (46). The second card securing means is designed so as to ensure that once the second card (14) is secured to the second card holding component (46), the removal of the second card (14) from the second card holding component (46) requires either the destruction of the second card (14) or tampering of the second card holding component (46).

Furthermore, the linking means is designed so that once the first and second card holding components (44), (46) are linked together, the separation of the first and second card holding components (44), (46) from each other requires tampering of the component linking means. Thus, the card holder (10) is specifically designed so that once the first and second cards (12), (14) are inserted thereinto, the first and second cards (12), (14) remain securely linked together and further ensuring that the separation of the first and second cards (12), (14) requires noticeable tampering or destruction of either the first and second cards (12), (14) or the card holder (10).

Figure 2:
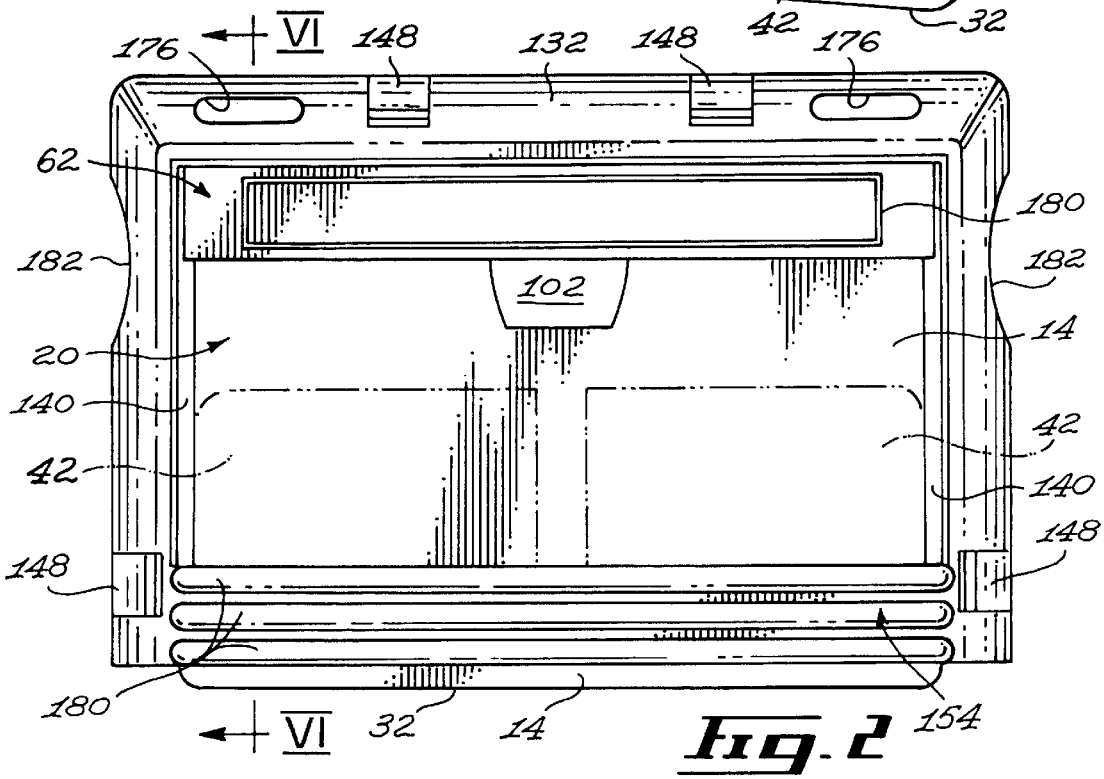
FIG. 2: in an elevational view, illustrates a card holder in accordance with an embodiment of the present invention, the card holder being shown with a pair of cards attached thereto and in a storage configuration.
Figure 3:
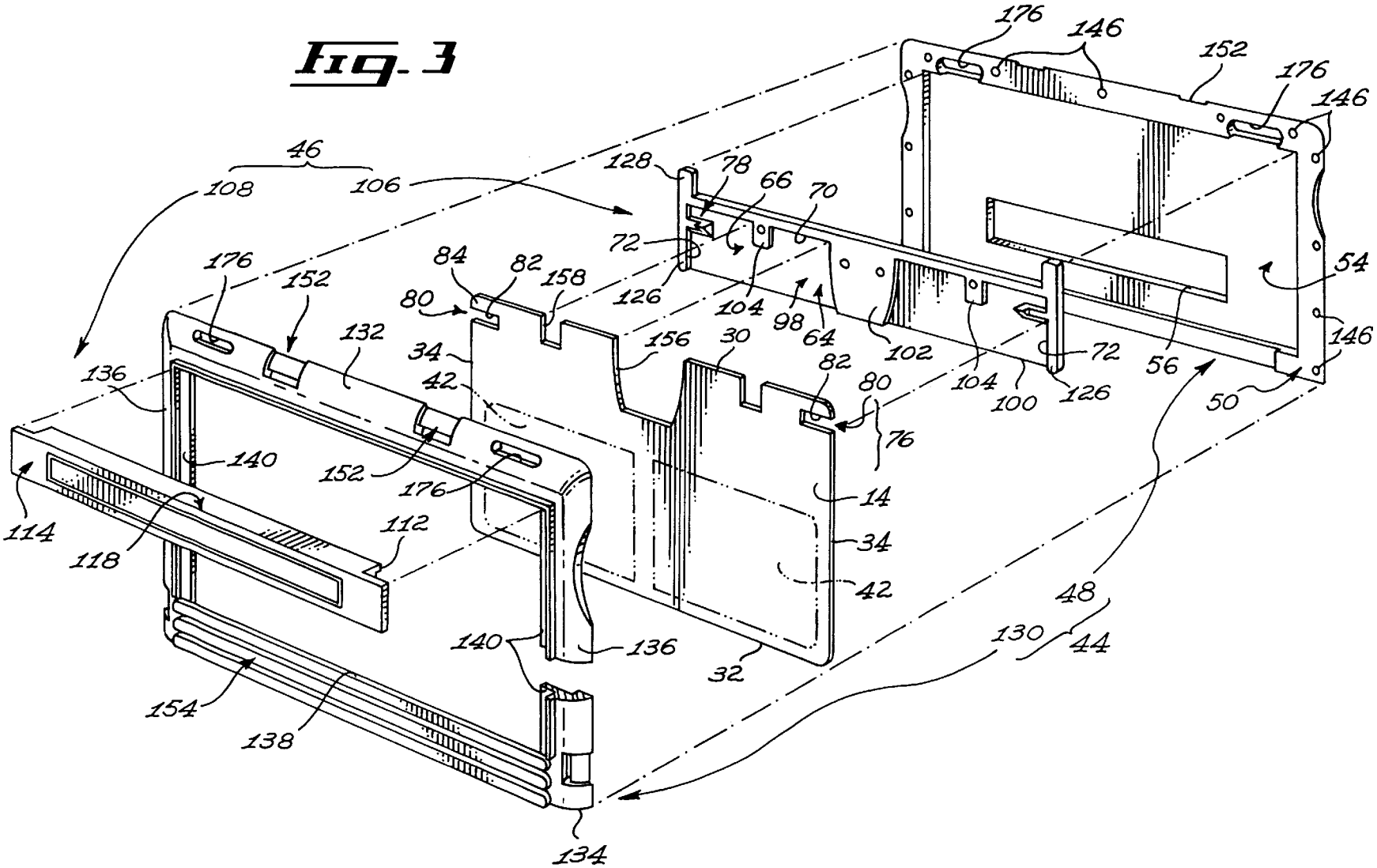
FIG. 3: in a partial exploded view, illustrates a card holder in accordance with an embodiment of the present invention with a card about to be attached thereto.
Figure 6:
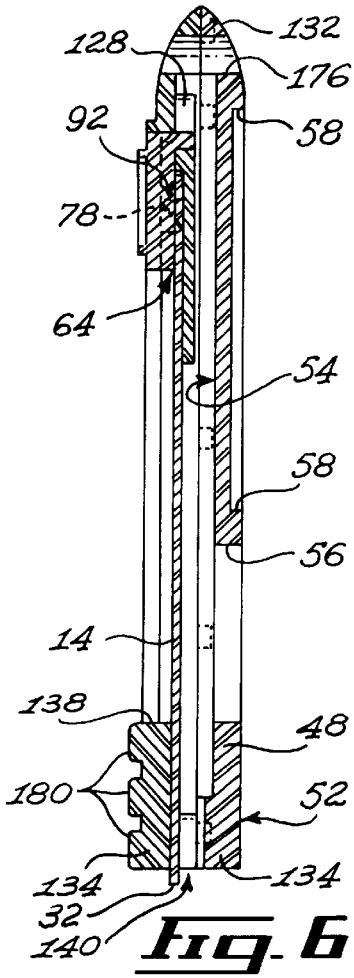
FIG. 6: in a transversal cross sectional view taken along arrows VI—VI of FIG. 2, illustrates a card holder in accordance with an embodiment of the present invention with a pair of cards attached thereto in a storage configuration.
Figure 7:
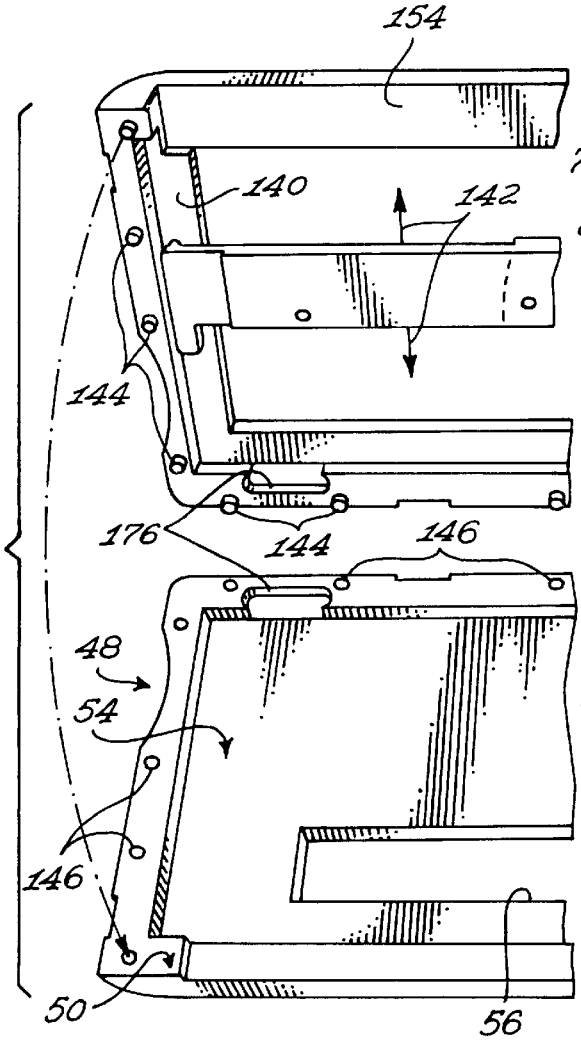
FIG. 7: in a partial perspective exploded view with sections taken out, illustrates part of the card holder in accordance with an embodiment of the present invention having a sectioned first card holding component about to be assembled together.

The linking means also preferably allows the first and second card holding components (44), (46) to be moved between a storage configuration, illustrated in FIGS. 2, 4 and 6, wherein the first and second card holding components (44), (46) are in a generally superposed configuration relative to each other and a display configuration shown in FIG. 1, wherein at least a section of the first and second cards (12), (14) are in a generally offset relationship relative to each other. The storage configuration produces the storage space required for the card holder (10), while the display configuration allows the simultaneous display of at least a section of both the first face (16) and the second card first face (20).

The first card holding component (44) includes a first component plate (48). As shown more specifically in FIGS. 3 through 7, the first component plate (48) defines a plate first surface (50) and an opposed plate second surface (52). Optionally, the plate first surface (50) is provided with card receiving recess (54), configured and sized for receiving the first card (12).

The first card second face (18) is adapted to be secured to the plate first surface (50) preferably in the card receiving recess (54) by the first card securing means. Typically, the first card securing means includes a layer of adhesive material (not shown) binding the first card second face (18) to the plate first surface (50).

In a preferred embodiment of the invention, the first component plate (48) is provided with an identification sticker reading aperture (56) extending therethrough. As shown more specifically in FIG. 4, the identification sticker reading aperture (56) is configured, sized and positioned so as to be substantially in register with the identification strip (40) when the first card (12) is mounted in the card receiving recess (54).

Optionally, the plate second surface (52) is provided with a message sticker receiving recess (58) formed thereinto. As illustrated more specifically in FIG. 4, the message sticker receiving recess (58) is intended to receive a self-adhesive message sticker (60) or any other suitable substrate bearing a suitable message such as instructions on how to use the card, safety tips, advertisement or the like.

The second card holding component (46), includes a carriage component (62). The carriage component (62) defines a carriage body having a carriage slot (64) extending thereinto.

The carriage slot (64) defines a carriage slot first inner surface (66), an opposed carriage slot second inner surface (68), a carriage slot upper peripheral edge (70), a pair of opposed carriage slot side peripheral edges (72) and a slot insertion axis (74) extending in a direction generally parallel to the carriage slot first and second inner surfaces (66), (68).

The second card (14) defines a marginal section (76) thereof adapted to be inserted into the carriage slot (64). The marginal section (76) typically extends downwardly from the second card upper peripheral edge (30). The carriage slot (64) is configured and sized for slidably receiving the second card marginal section (76) with the second card first and second faces (20), (22) in the region of the second card marginal section respectively facing the second card, second and first surfaces (68), (66).

The second card securing means include a second card-to-carriage locking means located in the carriage slot (64). The second card-to-carriage locking means ensures that once the second card marginal section (76) is slidably inserted in the carriage slot (64), the removal of the second card marginal section from the carriage slot (64) requires the destruction of the second card (14) or tampering of the second card holding component (46).

The second card-to-carriage locking means preferably includes a card locking protrusion (78) extending partially between the carriage slot first and second inner surfaces (66), (68). The second card-to-carriage locking means also preferably includes a card locking aperture (80) formed in the marginal sectional (76). The card locking aperture is configured, sized and positioned so as to receive the card locking protrusion when the marginal section (76) is inserted into the carriage slot (64). The carriage slot (64), the card locking protrusion (78) and the card locking aperture (80) are configured and sized so as to prevent the withdrawal of the card locking protrusion (78) from the card locking aperture (80) once the card locking protrusion (78) has been inserted into the card locking aperture (80).

Preferably, the second card-to-carriage locking means includes a pair of card locking protrusion (78) each of which located adjacent the broad side peripheral edges (72) and a corresponding pair of locking apertures (80) located adjacent the second card side peripheral edges (34).

The marginal section (76) is preferably made out of a substantially resilient material such as a suitable polymeric resin. The card locking aperture (80) preferably takes the form of a notch extending from both second card side peripheral edges (34) into the marginal section (76). Each aperture or notch (80) defines a notch locking edge (82). Each notch (82) also defines a card resilient flap (84) extending from one of the second card side peripheral edges (34) intermediate the notch locking edge (82) and the second card upper peripheral edge (30).

As shown more specifically in FIG. 5, each card locking protrusion (78) defines a protrusion distal tip (86). Also, each card locking protrusion (78) has a generally beveled configuration defining a protrusion locking surface (88) extending in a geometrical plane generally perpendicular to the slot first inner surface (66) and a protrusion segment guiding surface (90) extending in a geometrical plane generally at an angle relative to the protrusion locking surface (88).

The protrusion tip (86) is typically spaced from an opposite peripheral surface of the carriage slot (64) by an insertion spacing (92). In a preferred embodiment of the invention, an insertion recess (94) is formed in the opposite surface located opposite the protrusion tip (86). Typically, when the card locking protrusion (78) extends from the slot first inner surface (66), the insertion recess (94) is formed in the slot second inner surface (68). The card locking protrusion (78) is configured and sized so that the protrusion tip (86) is positioned substantially in register with the entrance of the insertion recess (94).

Preferably, the carriage component (62) has a generally parallelepiped-shaped configuration defining a carriage front wall, a carriage rear wall, a carriage top wall and a carriage bottom wall. The carriage slot (64) typically extends into the carriage bottom wall.

A protective skirt (96) typically extends from the carriage rear wall in a direction leading away from the carriage bottom wall. The protective skirt (96) defines a skirt inner surface (98). The skirt inner surface (98) is in a substantially coplanar relationship relative to the carriage slot first inner surface (66). The protective skirt (96) also defines a protective skirt lower peripheral edge (100). The protective skirt (96) thus protrudes downwardly from the slot first inner surface (66) below the level of the first slot (64).

At least one and preferably three stabilizing protrusions protrude from the carriage slot first inner surface (66) towards the carriage slot second inner surface (68). In a preferred embodiment of the invention, a relatively centrally disposed stabilizing protrusion (102) protrudes not only from the carriage slot first inner surface (66) but also from the skirt inner surface (98). The central stabilizing protrusion extends from a position adjacent the slot upper peripheral edge (70) to the skirt lower peripheral edge (100). Preferably, a pair of lateral stabilizing protrusions (104) positioned laterally relative to the central stabilizing protrusion (102), extend from the position adjacent the slot upper peripheral edge (70).

Preferably, the carriage component (62) includes a first carriage section (106) and a second carriage section (108). The first and second carriage sections (106), (108) are configured so as to define the carriage component (62) when assembled together in a carriage assembled configuration shown in FIGS. 1, 2 and 6. A carriage section securing means is provided for securing the first and second carriage sections (106), (108) in the carriage assembled configuration. The first carriage section (106) includes a generally flat first section panel. The inner surface of said first section panel forming said carriage slot first inner surface and said skirt inner surface. Said second carriage section (108) including a generally elongated second section block (110) having a second section flange (112) extending perpendicularly therefrom.

The rear section of the second section block (110) forms a carriage front wall (114) while the bottom section of the second section block (110) forms a carriage lower wall (116). The inner surface of the second section block (110) forms the slot second inner surface (68). The top section of the second section block (110) along with the second section flange (112) form a carriage top wall (118).

The card locking protrusions (78) and the stabilizing protrusions (102), (104) thus protrude from the inner surface of the first carriage section (106).

Figure 8:
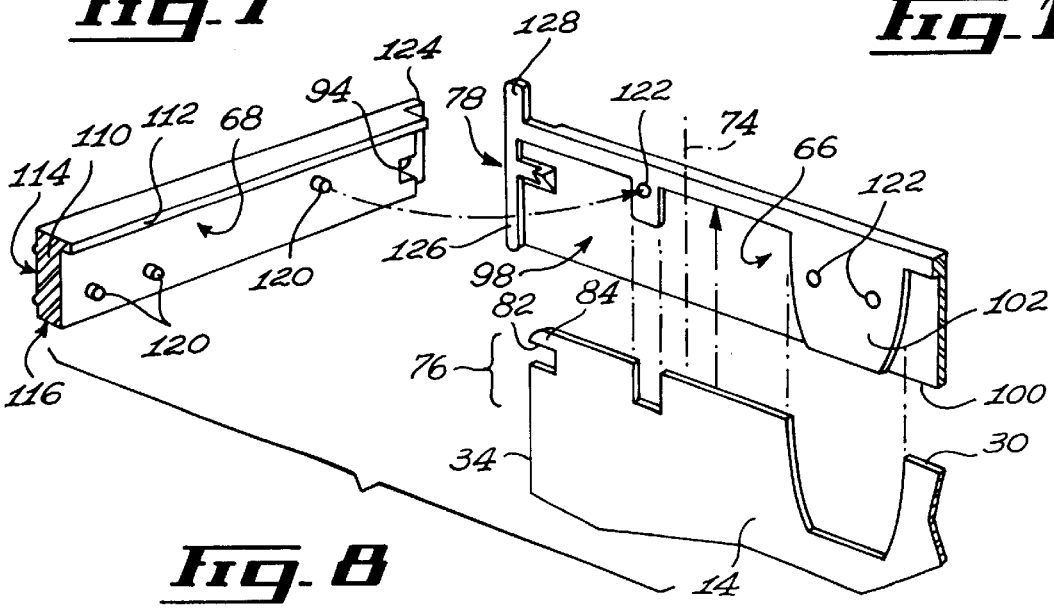
FIG. 8: in a partial perspective exploded view with sections taken out, illustrates part of a sectioned second card holding component being assembled and having a card attached thereto.

As illustrated more specifically in FIG. 8, the carriage section securing means preferably includes carriage securing pins (120) extending from the inner surface of the second section block (110) and carriage securing apertures (122) formed in the stabilizing protrusions (102), (104). Each carriage securing aperture (122) being configured, sized and positioned for lockingly receiving a corresponding carriage securing pin (120). Preferably, the carriage section securing means further includes a layer of adhesive material (not shown) binding the stabilizing protrusions (102), (104) to the inner surface of the second section block (110).

The component linking means preferably allows the first and second card holding components (44), (46) to be slidably moved relative to each other between the storage and display configurations respectively illustrated in FIGS. 2 and 1. In an alternative embodiment of the invention (not shown), the first and second card holding components are pivotable relative to each other about adjacent edges thereof.

In the illustrated embodiments, the component linking means includes a skate and rail arrangement extending between the first and second card holding components (44), (46). Typically, a guiding skate standing from each of the carriage side walls. The guiding skate is typically formed by a skate flange (124) extending laterally from the side walls of the second section block (110) and a skate leg (126) extending laterally from the side edges of the first section panel. Each adjacent set of skate flange and leg (124), (126) defines a rail receiving spacing therebetween for slidably receiving a guiding rail.

The skating legs (126) typically define a skate protruding segment (128) extending upwardly from the peripheral edge of the first section panel for stabilizing the movement of the carriage component (62) as the latter slides relative to the guiding rail. The first card holding component (44) preferably further includes a first component window frame (130) maintained in a generally parallel and spaced relationship relative to the first component plate (48) by a first component top wall (132), a first component bottom wall (134) and a pair of first component side walls (136). The first component frontal frame (130) surrounds a window aperture (138).

The first component bottom wall (134) has a first component slot (140) extending therethrough. The first component slot (140) allows the slidable movement of the second card (14) when the card holder (10) switches between the storage and display configurations. The window aperture (138) allows for the display of the first card first face (16) when the card holder (10) is in a display configuration shown in FIG. 1 and also allows for the display of the second card first face (20) when the card holder (10) is in the storage configuration, shown in FIG. 2.

The first component plate (48), the first component frontal frame (130), the first component top wall (132), the first component bottom wall (134) and the first component side walls (136) thus form a hollow casing for containing both the first and second cards (12), (14) when the card holder (10) is in the storage configuration shown in FIG. 2 and for allowing the selective display of the both the first and second cards (12), (14) when the card holder (10) is in the display configuration shown in FIG. 1.

A guiding rail (140) preferably extends inwardly from each of the first component side walls (136). The guiding rails (140) are configured and sized so as to be inserted between the skate flange and legs (124), (126), guiding the carriage component (62) as it slides relative to the first card holding component (44) as indicated by arrows CXLII in FIG. 7.

The first component frontal frame, the first component top wall (132), the first component bottom wall (134) and the first component side walls (136) are preferably formed out of an integral piece of material performing an integral first component frame. The first component frame is assembled and secured to the first component plate (48) using a first component securing means.

The first component securing means preferably includes a set of first component fastening pins (144) extending from an inner surface of the first component frame. A set of corresponding first component securing apertures (146) are formed in peripheral region of the plate first surface (50) for lockingly receiving the first component securing pins (144).

Figure 14:
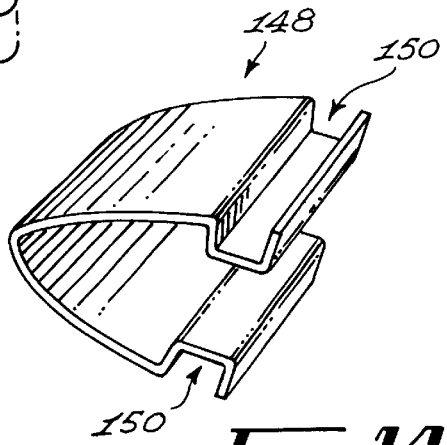
FIG. 14: in a perspective view, illustrates a clip optionally used for securing together the sections of a first card holding component used with the card holder in accordance with the present invention.
Figure 15:
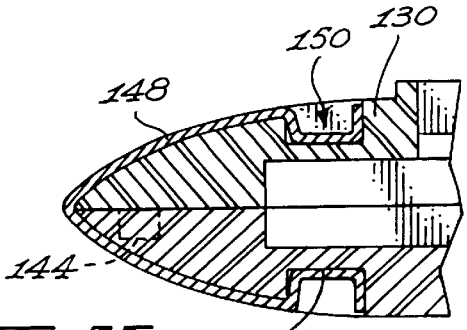
FIG. 15: in a partial transversal cross sectional view with sections taken out, illustrates the clip shown in FIG. 14 holding together the sections of the first card holding component used with the card holder in accordance with an embodiment of the present invention.

The first component securing means preferably further includes a set of securing clips (148), illustrated in greater details in FIGS. 14 and 15. The securing clips (148) are provided with generally U-shaped clip legs (150) adapted to be inserted into corresponding clip recesses (152) provided in both the first component plate (48) and the first component frame (130). The first component securing means preferably still further includes a layer of adhesive material bonding an inner peripheral surface of both the first component plate (48) and the first component frame (130).

Preferably the secured lower peripheral edge (100) is adapted to be substantially in register with the first component bottom wall (140) when the card holder (10) is in the display configuration, shown in FIG. 1. The second card securing means thus further includes the combination of the protective skirt (96) and a front segment (154) of the first component front wall that combine to form a shield preventing access to the card-to-carriage locking means and associated structures when the card holder (10) is in the more vulnerable display configuration, shown in FIG. 1.

The card holder (10) preferably further includes a selection means for selectively facilitating the destruction of the second card (14) without tampering of the card holder (10) so as to facilitate the withdrawal of the second card (14) from the card holder (10) without tampering or destruction of the latter. When the stabilizing protrusions (102) and (104) are provided, the second card upper peripheral edge (30) is provided with corresponding protrusion receiving notches (156).

Figure 10:
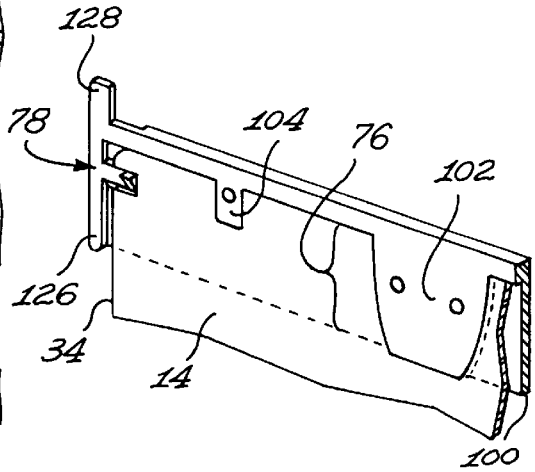
FIG. 10: in a partial perspective view, illustrates a card inserted into part of a second card holding component used with a card holder in accordance with an embodiment of the present invention.
Figure 11:
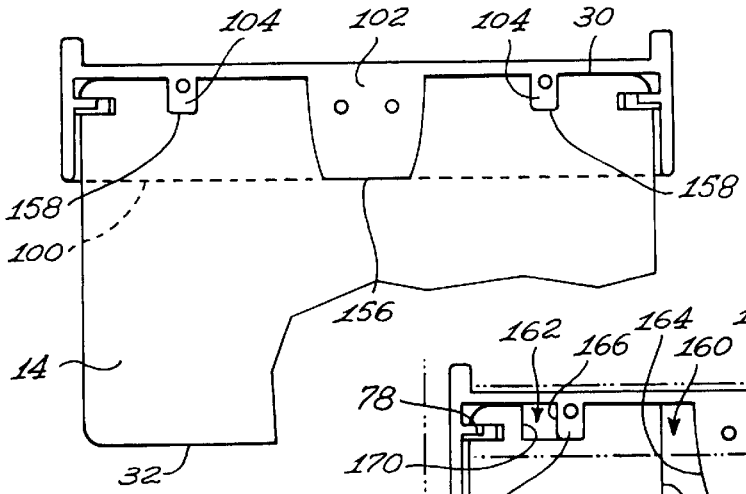
FIG. 11: in a partial elevational view with sections taken out, illustrates a card in accordance with a first embodiment of the invention inserted into part of a second card holding component used with a card holder in accordance with an embodiment of the present invention.

As shown more specifically in FIGS. 10 and 11, the protrusion notch recesses (156), (158) are preferably configured and sized so as to substantially fittingly receive a corresponding stabilizing protrusions (102), (104). This reduces the risk of having the second card displaced relative to the locking protrusions (78) and, thus, reduces the risk of having the second card illegally moved from the second card holding component (46).

Figure 12:
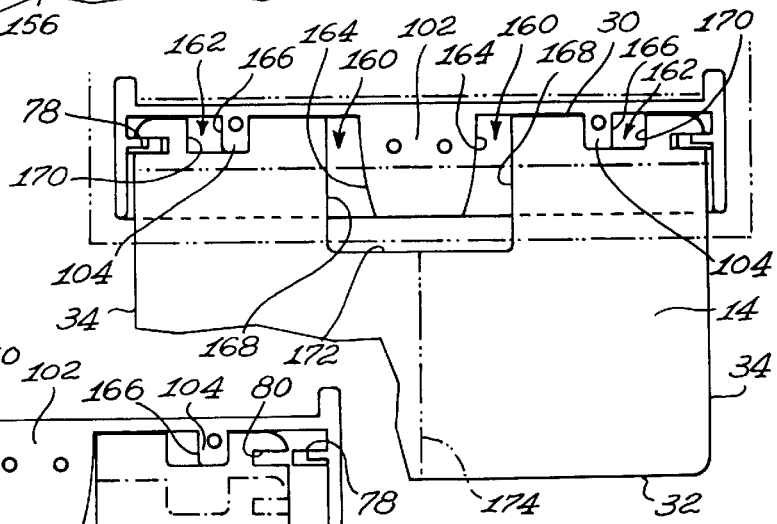
FIG. 12: in a partial elevational view with sections taken out, illustrates a card in accordance with a second embodiment of the invention inserted into part of a second card holding component used with a card holder in accordance with an embodiment of the present invention.
Figure 13:
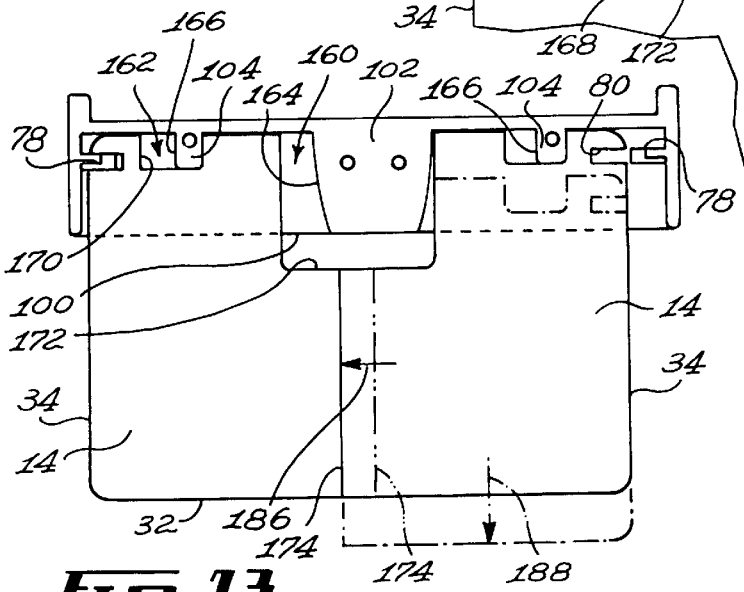
FIG. 13: in a schematic elevational view, illustrates the card shown in FIG. 12 being removed from the second card holding component also shown in FIG. 12.

In an alternative embodiment provided with the section means, illustrated in FIGS. 12 and 13, both the stabilizing protrusion receiving notches (156) and (158) are generally oversized relative to the corresponding stabilizing protrusions (102), (104). More specifically, the stabilizing protrusion recesses (156), (158) define a lateral clearance (160), (162) between a lateral edge (164), (166) of the stabilizing protrusions (102), (104) and an adjacent lateral edges (168), (170) of the corresponding stabilizing protrusion receiving recesses (156), (158) located proximal the carriage component side peripheral edges.

Furthermore, the stabilizing protrusion receiving recess (156) defines a protrusion recess lower peripheral edge (172) while it extends below the skirt lower peripheral edge (100). Still further, the second card (14) when provided with the selection means, preferably also includes a weakened line (174) extending from the second card lower peripheral edge to the stabilizing protrusion receiving recess (172). The weakened line (174) is typically made by dividing perforations through the second card (14) therealong.

The card holder (10) preferably still further includes strap receiving recesses (176) typically extending through the first component front and rear walls adjacent the first component top wall and adapted to receive corresponding strap segments (178) part of a carrying strap (only a segment of which is shown) that can be used around the neck or other body parts of an intended user for carrying the card holder (10).

The side peripheral edges of the card holder (10) are preferably provided with prehension recesses (182) formed thereinto for facilitating the prehension of the card holder (10) by the fingers of an intended user.

The clip components (148) are adapted to be made out of a relatively strong metallic alloy in order to reduce the risks of tampering card holder (10) by attempting to separate the window frame (130)from the first component plate (48). The remainder of the card holder (10) is typically made out of a suitable polymeric resin through a conventional injection molding process or the like. It should be understood that the clip (148) and other components for the card holder (10) could be made out of other materials and manufactured through other manufacturing processes without departing from the scope of the present invention.

When the card holder (10) is made out of a polymeric resin, using an injection molding-type of manufacturing process, reinforcement ribs typically protrude from the outer surface of the card holder (10) at strategic locations.

Prior to the use of the holder (10), the first card (12) is initially secured to the plate first surface (50) in the card receiving recess (54) using an adhesive material or the like. Alternatively, the first card (12) could be considered a virtual card and the information typically marked thereon could be directly marked onto the plate first surface. It should thus be understood that the term "first card" could be used loosely to indicate any suitable means of providing visual identification information or the like.

Figure 9:
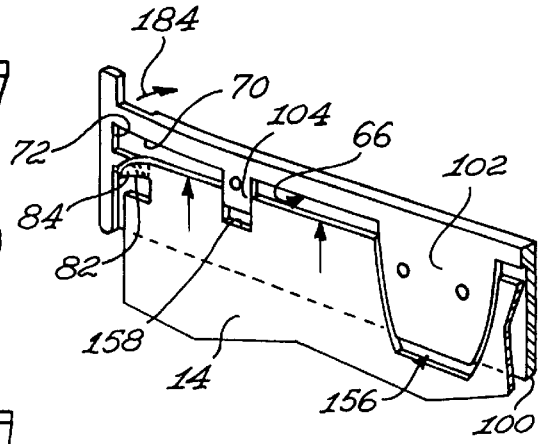
FIG. 9: in a partial perspective view, illustrates a card being slidably inserted into part of a second card holding component used with a card holder in accordance with an embodiment of the present invention.

Also, prior to the use of the card holder (10), the second card (14) must be secured to the carriage component (62). Referring to FIGS. 8 through 10, there is shown that the specific configuration of the carriage component (62) and its card-to-carriage locking means facilitates securing of the second card (14) to the carriage component (62). Indeed, the second card (14) merely needs to be slidably inserted into the carriage slot (64) along the carriage slot insertion access (74).

As shown in FIG. 8, when the card resilient flap (84) is unbiased, it lies in a generally coplanar flat initial configuration relative to the rest of the second card (14). As shown in FIG. 9, when the marginal section (76) is inserted into the carriage slot (64) the card resilient flap (84) extends sidewardly towards the slot second inner surface (68) onto the guiding surface (90) of the locking protrusion (78). The resilient flap (84) eventually passes through the insertion spacing typically created by the recess (94) and, once the notch locking edge (82), the resilient flap (84) springs back to its flat initial configuration as indicated by arrows CLXXXIV in FIG. 9. Once the resilient flap (84) has sprung back to its initial flap configuration with the notch locking edge (82) abuttingly contacting the protrusion locking surface (88), a combination of the locking notch (80) and of the locking protrusion (78) prevents the withdrawal of the marginal section (76) from the carriage slot (64).

The inner volume formed by the casing defined by the assembled first component plate (48) and first component frame (130) being somewhat larger than the window aperture (158), the casing peripheral edges also act as both a first and second card securing means. Still further, since the skirt lower peripheral edge (100) lies substantially in register with the frame bottom wall (134) when the card holder is in the vulnerable display configuration, illustrated in FIG. 1, the section (154) of the first component front wall further acts as a second card securing means.

In certain situations it may be desirable to allow the intended user to remove the second card (14) from the carriage component (62) as long as the removal of the second card (14) from the carriage component (64) leaves a permanent easily identifiable clue to the fact that the card (14) has been removed. For example, it may be desirable to allow public transit users to change a monthly transit card attached to an identification card. In such situations, the selection means, illustrated in FIGS. 12 and 13, allows removal of the second card (14) as long as the latter is destroyed during the removal process.

In order to facilitate the destruction of the second card (14) without tampering the card holder (10) so as to facilitate the withdrawal of the second card (14) from the card holder (10) without tampering or destruction of the latter, an intended user merely needs to cut or sever the second card (14) along the weakened line (174) from the second card lower peripheral edge (32) to the stabilizing protrusion receiving recess lower peripheral edge (172).

Once the second card (14) has been cut along the weakened line (174) it forms two distinct sections. Indeed, since the stabilizing protrusion receiving recess lower peripheral edge (172) is positioned underneath the skirt lower peripheral edge (100), the second card (14) can be cut completely without interference of the protective skirt (100).

Once the second card (14) has been cut, then clearances (162), (174) allows each segment of the second card (14) to slide laterally as indicated by arrow CLXXXVI in FIG. 13 until the corresponding locking notch (80) has cleared the corresponding locking protrusion (78). Once the locking notch (80) has cleared the locking protrusion (98), the corresponding second card segment may be slidably removed from the carriage slot (64) as indicated by arrow CLXXXVIII in FIG. 13.

Once the second card (14) has been separated from the carriage component (62) another validated second card (14) may again be secured to the carriage component (62) using the second card securing means by slidable insertion as illustrated in FIGS. 8 through 10.

Hence, the present invention with a first configuration of the second card (14) illustrated in FIG. 11, allows for permanent securing of both the first and second cards (12) and (14) thereto. The same card holder (10) with the second configuration of the second card (14), illustrated in FIGS. 12 and 13, allows for securing of the first card (12) to the card holder (10) and for temporary securement of the second card (14) to the card holder (10) as long as the removal of the second card (14) leaves a permanent clue to the fact that the second card (14) has been removed from the card holder (10).

When both the first and second cards (12), (14) are secured to the card holder (10) the latter may be used for allowing the selective display of the first and second cards (12), (14). The card holder (10) is typically carried in its storage configuration, illustrated in FIG. 2, wherein retraction of the second card (14) within the casing formed by the card holder (10) reduces the required storage space.

When the first and second cards (12), (14) need to be simultaneously displayed in order for coupling the visual information provided by the identification card and the validation card, the intended used merely need to grasp the casing preferably by inserting opposed fingers in the finger receiving recesses (182). The weights of the second card (14) and of the carriage component (62) will bias the second card (14) towards its display configuration, shown in FIG. 1, wherein the first and second cards (12), (14) are in a generally offset relationship to each other allowing the simultaneous display of at least a section of both the first card first face (16) and the second card first face (20).

The second card may be easily brought back to the storage configuration, shown in FIG. 2, by sliding the carriage component (62) with the finger inserted between reinforcement strips (180) extending therefrom or merely by pivoting the card holder (10) and allowing gravity to bias the carriage component (62) and associated second card (14) towards the storage configuration.

The embodiments of the invention in which an exclusive privilege or property is claimed are defined as follows:

1. A card holder for securely linking together a first card and a second card and for allowing the selective display of said first and second cards, said first card having a generally flat configuration defining a first card first face and an opposed first card second face, said second card having a generally flat configuration defining a second card penpheral edge, a second card marginal section extending from said second card peripheral edge, a second card first face and an opposed second card second face, said card holder comprising:

a first card holding component for holding said first card, said first card holding component being provided with a first card securing means for securing said first card to said first card holding component, said first card securing means including a portion of said card holding component being in restraining contact with at least a portion of both said first card first face and said first card second face, said first card securing means ensuring that once said first card is secured to said first card holding component the removal of said first card from said first card holding component requires a permanent and noticeable modification by tampering of said first card or of said first card holding component;

a second card holding component for holding said second card, said second card holding component being provided with a second card securing means for securing said second card to said second card holding component, said second card securing means ensuring that once said second card is secured to said second card holding component the removal of said second card from said second card holding component requires the destruction of said second card or permanent and noticeable modification by tampering of said second card holding component;

a component linking means for securely linking together said first and second card holding components, said linking means ensuring that once said first and second card holding components are linked together, the separation of said first and second card holding components from each other requires tampering of said component linking means.

2. A card holder as recited in claim 1 wherein said component linking means allows said first and second card holding components to be moved between a is storage configuration wherein said first and second card holding components are in a generally superposed configuration relative to each other with at least a section of said first card being displayed and a display configuration wherein at least a section of said first and second cards are in a generally offset relationship relative to each other;

whereby said storage configuration reduces the storage space required for storing said card holder while allowing the display of at least a section of said first card and said display configuration allows the simultaneous display of at least a section of both said first card first face and said second card first face.

3. A card holder for securely linking together a first card and a second card and for allowing the selective display of said first and second cards, said first card having a generally flat configuration defining a first card first face and an opposed first card second face, said second card having a generally flat configuration defining a second card peripheral edge, a second card marginal section extending from said second card peripheral edge, a second card first face and an opposed second card second face, said card holder comprising:

a first card holding component for holding said first card, said first card holding component being provided with a first card securing means for securing said first card to said first card holding component, said first card securing means ensuring that once said first card is secured to said first card holding component the removal of said first card from said first card holding component requires tampering of said first card or of said first card holding component;

a second card holding component for holding said second card, said second card holding component being provided with a second card securing means for securing said second card to said second card holding component, said second card securing means ensuring that once said second card is secured to said second card holding component the removal of said second card from said second card holding component requires the destruction of said second card or tampering of said second card holding component;

a component linking means for securely linking together said first and second card holding components, said linking means ensuring that once said first and second card holding components are linked together, the separation of said first and second card holding components from each other requires tampering of said component linking means; said component linking means allowing said first and second card holding components to be moved between a storage configuration wherein said first and second card holding components are in a generally superposed configuration relative to each other and a display configuration wherein at least a section of said first and second cards are in a generally offset relationship relative to each other;

whereby said storage configuration reduces the storage space required for storing said card holder and said display configuration allows the simultaneous display of at least a section of both said first card first face and said second card first face;

said first card holding component including a first component plate, said first component plate defining a plate first surface and an opposed plate second surface, said first card second face being secured to said plate first surface by said first card securing means;

said second card holding component including a carnage component, said carriage component defining a carriage body, said carriage body having a carriage slot extending thereinto, said carnage slot defining a carriage slot first inner surface, an opposed carriage slot second inner surface, a carriage slot upper peripheral edge, a pair of opposed carnage slot side peripheral edges, and a slot insertion axis extending in a direction generally parallel to said carriage slot first and second inner surfaces;

said carriage slot being configured and sized for slidably receiving said second card marginal section with said second card first and second faces in the region of said second card marginal section respectively facing said carriage slot second and first inner surfaces said second card securing means including a second card-to-carriage locking means located in said carriage slot, said second card-to-carriage locking means ensuring that once said second card marginal section is slidably inserted in said carriage slot the removal of said second card marginal section from said carriage slot requires the destruction of said second card or tampering of said second card holding component.

4. A card holder as recited in claim 3 further comprising a selection means for selectively facilitating the destruction of said second card without tampering of said card holder so as to facilitate the withdrawal of said second card from said card holder without tampering or destruction of said card holder.

5. A card holder as recited in claim 3 wherein said second card-to-carriage locking means includes a card locking protrusion extending partially between said carriage slot first and second inner surfaces;

a card locking aperture formed in said marginal section, said card locking aperture being configured, sized and positioned so as to receive said card locking protrusion when said marginal section is inserted into said carriage slot;

said carnage slot, said card locking protrusion and said card locking aperture being configured and sized so as to prevent the withdrawal of said card locking protrusion from said card locking aperture once said card locking protrusion has been inserted into said card locking aperture.

6. A card holder as recited in claim 5 wherein said second card has a generally rectangular configuration defining a second card upper peripheral edge, a second card lower peripheral edge and a pair of opposed second card side peripheral edges;

said marginal section extends from said second card upper peripheral edge, said marginal section being made of a substantially resilient material;

said card locking aperture forms a notch extending from one of said second card side peripheral edges into said marginal section, said notch defining a notch locking edge, said notch also defining a card resilient flap extending from one of is said second card side peripheral edges intermediate said notch locking edge and said second card upper peripheral edge;

said card locking protrusion is positioned adjacent said slot side peripheral edge, said card locking protrusion defining a protrusion distal tip, said card locking protrusion having a generally beveled configuration defining a protrusion locking surface extending in a geometrical plane generally perpendicular to said slot insertion axis, said card locking protrusion also defining a protrusion segment guiding surface extending in a geometrical plane generally at an angle relative to said protrusion locking surface, said protrusion tip being spaced from an opposite peripheral surface of said carriage slot by an insertion spacing;

whereby when said card resilient flap is unbiased it lies in a generally coplanar flap initial configuration relative to the rest of said second card, when said marginal section is inserted into said carriage slot, said card resilient flap bends sidewardly as it slides onto said guiding surface eventually passing through said insertion spacing; once said notch locking edge has cleared said insertion spacing, said resilient flap springs back to its flap initial configuration with said notch locking edge abuttingly contacting said protrusion locking surface and preventing the withdrawal of said marginal section from said carnage slot.

7. A card holder as recited in claim 6 wherein an insertion recess is formed in said carriage slot opposite said protrusion tip, said protrusion tip being located substantially in register with the entrance of said insertion recess; whereby the locking protrusion temporarily biases said card resilient flap into said insertion recess as said resilient flap slides over said protrusion tip.

8. A card holder as recited in claim 6 wherein said carriage component includes a carriage front wall, a carriage rear wall, a carriage top wall and a carriage bottom wall, said carriage slot extending into said carriage bottom wall;

a protective skirt extending from said carriage rear wall in a direction leading away from said carriage bottom wall, said protective skirt defining a skirt inner surface, said skirt inner surface being in a generally coplanar relative to said carriage slot first inner surface, said protective skirt also defining a skirt lower peripheral edge;

a stabilizing protrusion protruding from said carriage slot first inner surface, said stabilizing protrusion extending from a position adjacent said slot upper peripheral edge to a position adjacent said skirt lower peripheral edge.

9. A card holder as recited in claim 8 wherein said carriage component includes a first carriage section and a second carriage section, said first and second carriage sections being configured so as to define said carriage component when assembled together in a carriage assembled configuration;

a carriage section securing means for securing said first and second carriage sections in said carriage assembled configuration.

10. A card holder as recited in claim 9 wherein said first carriage section includes a generally flat first section panel, the inner surface of said first section panel forming said carriage slot first inner surface and said skirt inner surface;

said second carriage section includes a generally elongated second section block having a second section flange extending perpendicularly therefrom;

the rear section of said second section block forming said carriage front wall while the bottom section of said second section block forms part of said carriage lower wall;

the inner surface of said second section block forming said slot second inner surface said second section flange and the top section of said second section block forming said carriage top wall.

11. A card holder as recited in claim 10 wherein said card locking protrusion and said stabilizing protrusion protrudes from the inner surface of said first carriage section;

said carriage section securing means includes carriage securing pins extending from the inner surface of said second section block and carriage securing apertures formed in said stabilizing protrusion, each of said carriage securing apertures being configured sized and positioned for lockingly receiving a corresponding carriage securing pin.

12. A card holder as recited in claim 3 wherein said component linking means allows said first and second card holding components to be slidably moved relative to each other between said storage and display configurations.

13. A card holder as recited in claim 12 wherein said component linking means includes a guiding skate and guiding rail arrangement extending between said carriage component and said first card holding component for allowing said carriage component and said first card holding component to slide relative to each other.

14. A card holder as recited in claim 13 wherein said first card holding component further includes a first component front wall maintained in a parallel and spaced relationship relative to said first component plate by a first component top wall, a first component bottom wall and a pair of first component side walls;

said first component front wall having a window aperture extending therethrough so that said first component front wall defines a window frame around said window aperture surrounding a window aperture;

said first component bottom wall having a first component slot extending therethrough;

said first component slot allowing the slidable movement of said second card thereinto when said card holder switches between said storage and display configurations;

said window aperture allowing the display of said first card first face when said card holder is in said display configuration and the display of said second card first face when said card holder is in said storage configuration; whereby said first component plate, said first component front wall, said first component top wall, said first component bottom wall and said pair of first component side walls form a hollow casing for containing both said first and second cards when said card holder is in said storage configuration.

15. A card holder as recited in claim 14 wherein said carriage component includes a carnage front wall, a carriage rear wall, a carriage top wall, a carriage bottom wall and a pair of carriage side walls, said carriage slot extending into said carriage bottom wall; said carriage component also including a protective skirt extending from said carriage rear wall in a direction leading away from said carriage bottom wall, said protective skirt defining a skirt inner surface substantially coplanar with said carriage slot first inner surface, said protective skirt also defining a skirt lower peripheral edge; a guiding rail extends inwardly from each of said first component side walls and a guiding skate extends from each of said carriage side walls.

16. A card holder as recited in claim 15 wherein said first component front wall, said first component top wall, said first component bottom wall and said pair of component side walls form an integral piece of material assembled and secured to said first component plate by a first component securing means.

17. A card holder as recited in claim 15 wherein said skirt lower peripheral edge is substantially in register with said first component bottom wall when said card holder is in said display configuration.

18. A card holder as recited in claim 17 further comprising a selection means for selectively facilitating the destruction of said second card without tampering of said card holder so as to facilitate the withdrawal of said second card from said card holder without tampering or destruction of the latter; said selection means including a card recess formed in said second card, said card recess extending from said second card upper peripheral edge to a position located below said carriage bottom wall when said marginal section is inserted into said carriage slot and said card holder is in said display configuration.

19. A card holder for securely linking together a first card and a second card and for allowing the selective display of said first and second cards, said first card having a generally flat configuration defining a first card first face and an opposed first card second face, said second card having a generally flat configuration defining a second card peripheral edge, a second card marginal section extending from said second card peripheral edge, a second card first face and an opposed second card second face, said card holder comprising:

a generally flat and hollow casing, said casing defining a casing front wall, an opposed casing rear wall, a casing top wall, an opposed casing bottom wall, a pair of casing side walls and a casing inner volume; said casing rear wall defining a rear wall inner surface and a rear wall outer surface; said casing front wall having a window aperture extending therethrough; said casing bottom wall having a bottom wall slot extending therethrough;

a carriage component slidably mounted within said casing inner volume;

a first card securing means for securing said first card to said rear wall inner surface, said first card securing means ensuring that once said first card is secured to said rear wall inner surface the removal of said first card from said rear wall inner surface requires tampering of said first card or of said first card or of said card holder;

a carriage component securing means for securing said second card to said carriage component, said carriage component securing means ensuring that once said second card is secured to said carriage component the removal of said second card from said carriage component requires the destruction of said second card or tampering of said card holder.

20. A card holder as recited in claim 19 wherein said carriage component securing means includes a carriage slot formed in said carriage component;

said carriage slot defining a carnage slot first inner surface, an opposed carriage slot second inner surface, a carriage slot upper peripheral edge, a pair of opposed carriage slot side peripheral edges, and a slot insertion axis extending in a direction generally parallel to said carriage slot first and second inner surfaces;

said carriage slot being configured and sized for slidably receiving said second card marginal section with said second card first and second faces in the region of said second card marginal section respectively facing said carriage slot second and first inner surfaces;

said second card securing means includes a second card-to-carriage locking means located in said carriage slot, said second card-to-carriage locking means ensuring that once said second card marginal section is slidably inserted in said carriage slot the removal of said second card marginal section from said carriage slot requires the destruction of said second card or tampering of said second card holding component.

* * * * *